US012313068B2

(12) United States Patent
Bohr et al.

(10) Patent No.: US 12,313,068 B2
(45) Date of Patent: May 27, 2025

(54) INTERNAL GEAR MACHINE WITH HELICAL TOOTHING

(71) Applicant: HYDRAULIK NORD TECHNOLOGIES GMBH, Parchim (DE)

(72) Inventors: Artur Bohr, Waldenbuch (DE); Thomas Pippes, Pinnow (DE)

(73) Assignee: HYDRAULIK NORD TECHNOLOGIES GMBH, Parchim (DE)

( * ) Notice: Subject to any disclaimer, the term of this patent is extended or adjusted under 35 U.S.C. 154(b) by 0 days.

(21) Appl. No.: 18/579,747

(22) PCT Filed: Jul. 20, 2022

(86) PCT No.: PCT/EP2022/070286
§ 371 (c)(1),
(2) Date: Jan. 16, 2024

(87) PCT Pub. No.: WO2023/011918
PCT Pub. Date: Feb. 9, 2023

(65) Prior Publication Data

US 2024/0360829 A1 Oct. 31, 2024

(30) Foreign Application Priority Data

Aug. 5, 2021 (DE) ..... 10 2021 120 395.3

(51) Int. Cl.
*F04C 2/107* (2006.01)
*F01C 21/10* (2006.01)
(Continued)

(52) U.S. Cl.
CPC ..... *F04C 2/107* (2013.01); *F01C 21/10* (2013.01); *F01C 21/108* (2013.01); *F04C 2/084* (2013.01);
(Continued)

(58) Field of Classification Search
CPC ..... F04C 2/107; F04C 2/084; F04C 2/101; F04C 15/00; F04C 15/0019; F04C 15/0023; F04C 15/0042; F01C 21/10; F01C 21/108
See application file for complete search history.

(56) References Cited

U.S. PATENT DOCUMENTS 1,531,904 A * 3/1925 Dinesen ..... F04C 2/101 418/169
1,768,818 A * 7/1930 Bock ..... F04C 2/101 418/170
(Continued)

FOREIGN PATENT DOCUMENTS

CN 104265623 B 8/2016
DE 4102162 A1 7/1992
(Continued)

OTHER PUBLICATIONS

German Patent Publication and Machine Translation for DE 10 2008 034 175 A1; 1st Inventor: Welschof; Title: Electrohydraulic Drive Arrangement for Driving . . . where Ventilation Device Cools Control Electronics Unit: Published: Jan. 28, 2010. (Year: 2010).*
(Continued)

*Primary Examiner* — Mary A Davis
(74) *Attorney, Agent, or Firm* — Norris McLaughlin, PA

(57) ABSTRACT

The invention relates to an internal gear machine (10) having a housing (12) which forms a cavity (14) in which an internally toothed ring gear (18) and an externally toothed pinion (16) are arranged, the toothings (24, 26) of which are in meshing engagement with one another in certain regions and the axes of rotation (20, 22) of which run parallel to and spaced apart from one another, wherein at least one filler piece (30, 30') rests against the first and second toothings (24, 26), which divides the cavity (14) into two fluidically
(Continued)

separate regions. It is provided that the toothing (24, 26) is designed as helical toothing or arrow toothing.

16 Claims, 9 Drawing Sheets

(51) Int. Cl.
*F04C 2/08* (2006.01)
*F04C 2/10* (2006.01)
*F04C 15/00* (2006.01)

(52) U.S. Cl.
CPC ..... *F04C 2/101* (2013.01); *F04C 15/00* (2013.01); *F04C 15/0019* (2013.01); *F04C 15/0023* (2013.01); *F04C 15/0042* (2013.01)

(56) References Cited

U.S. PATENT DOCUMENTS

| | | | | | |
|---|---|---|---|---|---|
| 2,349,022 | A * | 5/1944 | Ungar | F04C 2/084 | 29/889 |
| 3,679,335 | A * | 7/1972 | Zippel | F04C 2/101 | 418/170 |
| 4,089,625 | A * | 5/1978 | Hofmann, Jr. | F01C 21/06 | 418/83 |
| 4,132,514 | A * | 1/1979 | Eckerle | F04C 2/101 | 418/71 |
| 5,674,060 | A | 10/1997 | Buchmueller et al. | | |
| 7,665,445 | B2 | 2/2010 | Venkataraghavan et al. | | |
| 11,971,033 | B2 * | 4/2024 | Goss | F04C 2/101 | |
| 2009/0260599 | A1 | 10/2009 | Venkataraghavan et al. | | |
| 2013/0087002 | A1 | 4/2013 | Laetzel et al. | | |
| 2014/0030129 | A1 | 1/2014 | Heyer et al. | | |
| 2022/0243725 | A1 * | 8/2022 | Chenoux | F04C 2/101 | |

FOREIGN PATENT DOCUMENTS

| | | | |
|---|---|---|---|
| DE | 4322240 | C2 | 1/1997 |
| DE | 19826367 | A1 | 12/1999 |
| DE | 102009017371 | A1 | 2/2010 |
| DE | 102010063313 | A1 | 6/2012 |
| DE | 102011115010 | A1 | 4/2013 |

OTHER PUBLICATIONS

International Search Report dated Oct. 13, 2022, in connection with PCT International Application No. PCT/EP2022/070286.
English translation of International Search Report dated Oct. 13, 2022, in connection with PCT International Application No. PCT/EP2022/070286.
Written Opinion in connection with PCT International Application No. PCT/EP2022/070286 mailed Oct. 21, 2022.

* cited by examiner

INTERNAL GEAR MACHINE WITH HELICAL TOOTHING

This application is the U.S. National Stage of International Application No. PCT/EP2022/070286, filed Jul. 20, 2022, which claims foreign priority benefit under 35 U.S.C. § 119 of German Patent Application Nos. 10 2021 120 395.3, the disclosures of which are incorporated herein by reference.

BACKGROUND OF THE INVENTION

The invention relates to an internal gear machine.

Internal gear machines of the generic type are known.

DE 198 26 367 A1, for example, discloses an internal gear pump in the form of a gear ring pump without a filler piece for pumping low-viscosity liquids. The gear ring pump comprises a pump mount and a split bearing body made of low-wear special material embedded therein, which forms a cavity. An internally toothed ring gear and an externally toothed pinion are arranged in the cavity, the toothings of which are in meshing engagement with each other in certain regions. The axes of rotation of the ring gear and pinion are arranged parallel to and spaced apart from each other. The toothings of the ring gear and pinion can be helically toothed. The split bearing body receiving the ring gear and pinion consists of a disc and a ring gear mount, which form an axial and radial bearing. A kidney-shaped aperture in the ring gear mount or the disc is congruent with a corresponding aperture in the pump mount or the disc and together they form the inlet or outlet channel of the pump on one side when viewed axially. On the side facing away from the aperture to the cavity, blind kidneys are provided in the corresponding disc or the ring gear mount that are congruent with the inlet or outlet channel and prevent the meshing toothing from squeezing oil in a known manner.

DE 20 2009 017 371 U1 and DE 41 02 162 A1 also disclose helically toothed gear ring pumps.

Compared to straight-toothed internal gear pumps, which are also known to those skilled in the art, the known helically toothed internal gear pumps offer the advantage of greater mechanical smooth running, as the helically toothed teeth mesh with one another with a continuous transition.

The known helical internal gear pumps are suitable for use in the low-pressure range.

A disadvantage of the known helically toothed internal gear pumps is that they have no hydraulic gap compensation. Under hydraulic pressure, this leads to high leakage as well as axial thrust and a tilting moment transverse to the axis of rotation on the hydraulically pressurised helical toothing. This leads to edge pressure and, as a result, to a high drive torque and wear. As a result, the known helically toothed solutions exhibit poor volumetric and/or hydraulic-mechanical efficiency as well as rapid degradation under higher pressure loads.

The known helically toothed solutions are therefore not suitable for operation at typically required 250 bar, 280 bar or 350 bar and/or necessary temperature spreads of up to −40° C. to 120° C. or with corresponding viscosity spreads during operation.

In addition, a significant noise advantage is only achieved if the helix angle is at least so large that, for a given gearbox width, the helix angle leads to a relative face section twist from the front of the gearbox to the rear of the gearbox of approximately one tooth pitch. Conventional toothings, especially those of gear ring pumps without a filler piece, have a relatively low number of teeth, typically between 6 and 15 teeth on the pinion and between 7 and 16 teeth on the ring gear. As a result, the helix angle must be very large to achieve a full pitch, which means that the engagement distance required for sealing in the tooth engagement is not long enough or the degree of overlap is too small. As a result, helical toothing cannot be sealed, particularly with regard to high pressure, and therefore cannot fulfil the purpose of being suitable for high pressure and quiet at the same time.

In other words, a relatively high helix angle could be implemented, thus achieving a purely mechanical noise advantage. However, this results in the pump being leaky in the tooth engagement, i.e. high leakage, sudden pressure reduction and cavitation occur, which ultimately means that such a pump is much louder and less efficient than a pump without helical toothing. Alternatively, a helix angle could be implemented which results in a hydraulic seal just being achieved through the engagement distance. In fact, the helix angle for conventional toothings is so small that the noise advantage over spur toothing is marginal and the associated manufacturing effort is not justified.

In contrast to the known helically toothed internal gear pumps, straight-toothed hydraulically gap-compensated internal gear pumps are known.

For example, DE 43 22 240 C2 describes an internal gear pump that has sealing discs arranged axially on the gearbox end faces, whereby the discs are designed with mirror symmetry to the gearbox centre plane. Axial gap compensation is achieved by corresponding axial pressure fields in the housing or housing parts that are symmetrical to the centre plane of the gearbox. The pressure fields are designed in terms of surface and surface centre of gravity in such a way that the pressure acting within the straight-toothed gearbox and its axial force effect are compensated for, thereby forcing the discs to contact at every operating point. This effectively prevents leakage between the gearbox end face and the sealing discs. The pressure fields are also designed with an appropriate sealing system to seal the sealing discs to the housing. Radial gap compensation between segment-shaped filler pieces and the gearbox tooth heads is achieved by the fact that the gap between two filler pieces in contact with the tooth heads has sealing elements and the gap is connected to the high-pressure side, thus forcing radial contact with the toothing.

The known compensated straight-toothed internal gear pumps are suitable for high-pressure applications. They are characterised by a high volumetric and hydraulic-mechanical efficiency. A disadvantage is that the known designs are noisy when in use.

SUMMARY OF THE INVENTION

The object of the invention is to create a quiet helically toothed internal gear machine that can be operated with low wear and high efficiency in the high-pressure range.

According to the invention, this problem is solved by an internal gear machine comprising a housing which forms a cavity in which an internally toothed ring gear and an externally toothed pinion are arranged, the toothings of which are in meshing engagement with one another in certain regions and the axes of rotation of which run parallel to and spaced apart from one another, at least one filler piece resting against the first and second toothings, which divides the cavity into two fluidically separate regions, and the toothing is designed as helical toothing or arrow toothing, it is advantageously possible to provide an internal gear machine suitable for high-pressure operation with helical toothing, which has a high degree of mechanical smooth running and a high degree of efficiency. This avoids both noise due to the flowing hydraulic fluid and wear minimization on the rotating parts or the housing parts adjacent to the rotating parts.

In a preferred embodiment, it is provided that the surfaces axially closing the cavity have non-congruent pressure fields whose control edges are rotated relative to each other in the circumferential direction, preferably by the face section twist between the front and rear sides of the gearbox specified by helical toothing. The advantage of this is that tilting moments on the gearbox formed by the ring gear and pinion due to the helical toothing can be optimally compensated. In addition to axial and radial gap sealing, which leads to a high degree of efficiency, this also significantly supports smooth running and wear-free operation of the internal gear machine.

Furthermore, in a preferred embodiment of the invention, it is provided that the axial boundaries of the cavity on both sides each have at least one mutually non-congruent hydrostatic pressure field, which are designed such that a thrust exerted by the helically toothed pinion and helically toothed ring gear in the region of the filler piece, acting axially on one side, and a thrust acting in the region of the tooth engagement of ring gear and pinion, acting axially in the opposite direction to the first acting axial thrust, are at least partially hydrostatically compensated in terms of area. In this way, the tilting moment resulting from the intended use of the internal gear machine according to the invention can be optimally balanced.

In particular, if the non-congruent hydrostatic pressure fields balance the respective axially opposite thrusts in the region of the filler piece and in the region of the tooth engagement by at least 20%, at least 30%, at least 40%, at least 50%, at least 60%, at least 70%, at least 80% or at least 90% in terms of area, the internal gear machine can be used as intended with very smooth running and high wear resistance.

It is preferably provided that the cavity accommodating the internally toothed ring gear and the externally toothed pinion is axially bounded by at least one axial disk, the axial disk has at least one fluid connection between the cavity and a pressure field provided on the side of the axial disk facing away from the cavity which is in connection with the fluid connection and the side of the axial disk facing the cavity has at least one hydrostatic surface which is arranged non-congruently with the side facing away from the cavity and which is in operative connection with the pressure field, it is advantageously possible to achieve axial and radial gap compensation in a simple manner, so that such helically toothed internal gear machines can also be operated with high efficiency in the high-pressure range. In addition, it is advantageously possible to compensate for a tilting moment acting on the gearbox consisting of ring gear and pinion. The pressure field facing the cavity is smaller than the pressure field facing away from the cavity.

In accordance with the invention, non-congruently arranged surfaces are understood to mean that the pressure surfaces on both sides of the axial disc or the axial discs are different and/or the pressure fields have sections that increase and/or decrease in size (for example pockets or the like) when viewed in the circumferential direction of the axial disc and/or their control edges are twisted relative to one another in the circumferential direction In a preferred embodiment of the invention, it is provided that the opposing, non-congruent hydrostatic surfaces comprise relief grooves and/or pressure pockets. This makes it possible in a simple manner, through the arrangement and dimensioning of the relief grooves and/or pressure pockets, to form the opposing, non-congruent hydrostatic surfaces in such a way that hydrostatic relief of the tilting moments caused by the helically toothed pinion and ring gear can be absorbed depending on the operating point of the internal gear machine.

In a further preferred embodiment of the invention, it is provided that the toothings have a helix angle whose relative twist of the face section tooth contour from the front side of the gearbox to the rear side of the gearbox preferably corresponds to at least half a tooth pitch, in particular preferably a full tooth pitch. The front or rear side of the gearbox refers to the end faces of the pinion and ring gear meshing with each other. This makes it advantageous to use a relatively large helix angle. The internal gear machine can therefore be operated with a particularly high degree of efficiency, whereby the tilting moment emanating from the helical toothing with the helix angle can be absorbed by the opposing, non-congruent hydrostatic surfaces. In particular, this makes it possible to achieve very smooth running in the high-pressure range.

Furthermore, in a preferred embodiment of the invention, it is provided that a degree of overlap of the tooth engagements of the toothings is >=2. This makes it advantageously possible for the engagement distance in the tooth engagement to lead to complete sealing of the tooth engagement despite the full tooth pitch of the face section twist, with a relatively small helix angle.

Furthermore, in a preferred embodiment of the invention, it is provided that the number of teeth of the external toothing of the pinion is more than 15 and the number of teeth of the internal toothing of the ring gear is more than 20. Due to the relatively high number of teeth in conjunction with the helix angle and the full pitch of the cutting twist, in addition to a very smooth running of the internal gear machine, a large seal is simultaneously ensured in the engagement region between the pinion and ring gear.

In a further preferred embodiment of the invention, it is provided that the axial disc and/or the housing in the region of the axial disc comprises an axial recess which results in the pressure field and which is preferably surrounded by a sealing system, in particular a sealing ring. This makes it advantageously possible to achieve hydrostatic relief of the axial thrust exerted by the helical toothing and of the tilting moment acting transversely to the axis of rotation in cooperation with the non-congruently arranged hydrostatic surfaces provided on the side facing the cavity, with a high degree of effectiveness.

Furthermore, in a preferred embodiment of the invention, the internal gear machine comprises, in addition to the one axial disc on the opposite side of the cavity, at least one further axial disc, which preferably has a pressure field facing the cavity and a pressure field facing the housing, which are connected to each other via a fluid connection. This improves the axial and radial gap sealing, as this axial disc also comes to rest against the end face of the gearbox depending on the operating point.

Furthermore, in a preferred embodiment of the invention, it is provided that the pressure fields of one axial disc are not congruent with the pressure fields of the further axial disc. As a result, depending on the pressure conditions that occur when the internal gear machine is used as intended, very precise compensation of the tilting moment exerted by the helical toothing can be ensured, depending on the operating point, while guaranteeing effective axial and radial gap sealing.

Finally, in a further preferred embodiment of the invention, it is provided that pressure fields in the housing and/or pressure fields of at least one axial disc surrounding the end face of the ring gear are designed to be inversely symmetrical to one another with respect to the gearbox centre plane. A four-quadrant mode of the internal gear machine is possible by means of pressure fields designed in this way, so that compensation or counteraction of the tilting moment emanating from the helical toothing can take place at any time, even at high pressures, irrespective of the direction of rotation of the pinion and ring gear and an application-specific alternating pressure side and associated axially alternating thrust direction.

According to the invention, the internal gear machine is operated as a pump, as a hydraulic motor in reversing operation, in pure left-right operation or in four-quadrant mode, depending on the desired application. Due to the mutually non-congruent hydrostatic surfaces arranged on the gearbox end face, optimum compensation of the tilting moment is possible at all times with different operating pressures.

BRIEF DESCRIPTION OF THE DRAWINGS

The invention is explained in more detail below in embodiments with reference to the associated Figures, showing.

DETAILED DESCRIPTION OF THE INVENTION

Figure 1:
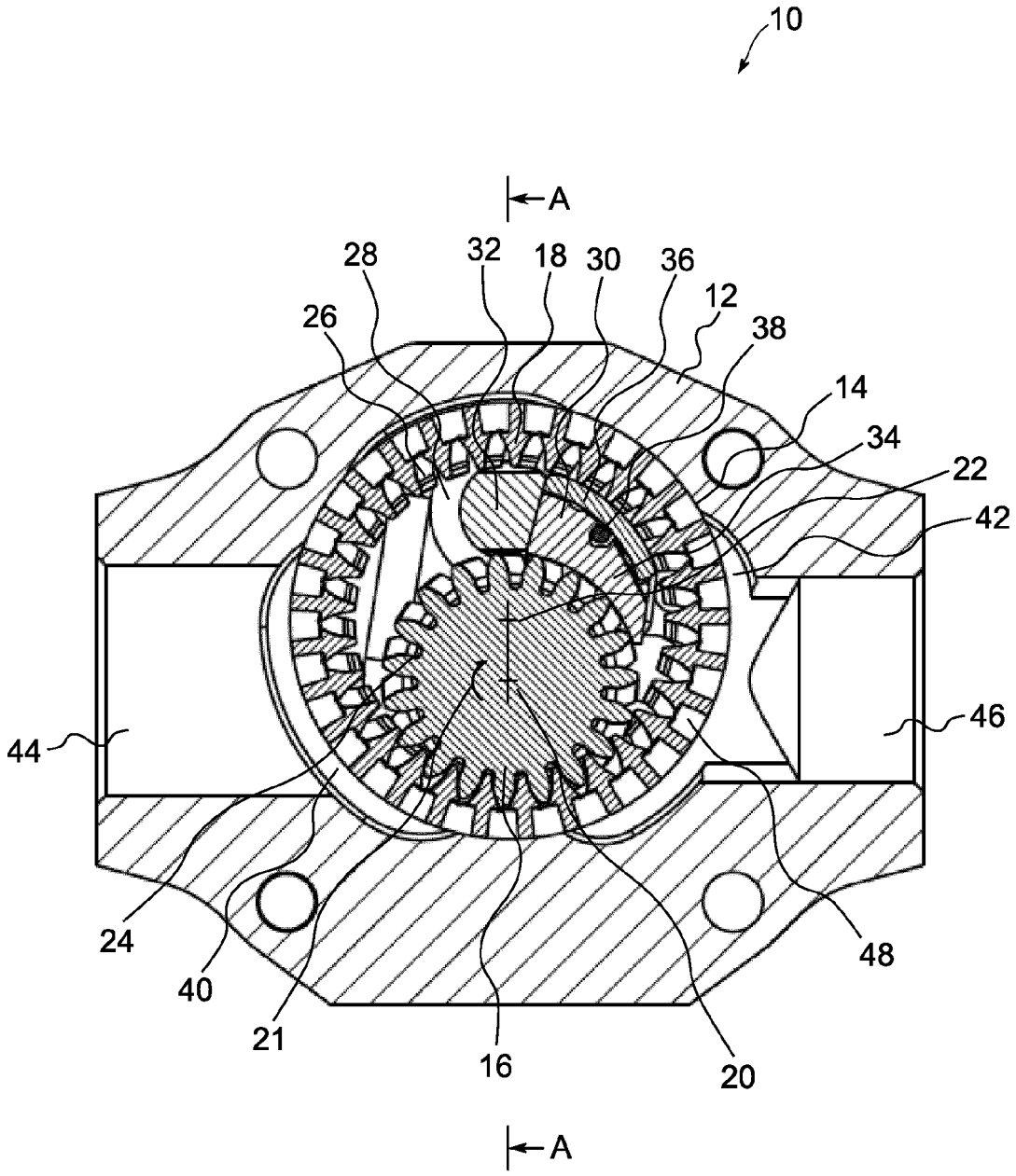
FIG. 1 a sectional view of a 2-quadrant internal gear machine.

FIG. 1 shows a sectional view of an internal gear machine referred to as 10. The internal gear machine 10 has a housing 12 within which a cavity 14 is formed. An externally toothed pinion 16 and an internally toothed ring gear 18 are arranged in the cavity 14. The pinion 16 is arranged to rotate about a longitudinal axis 20 and the ring gear 18 is arranged to rotate about a longitudinal axis 22. The longitudinal axes 20 and 22 thus form axes of rotation on the one hand for the pinion 16 and on the other hand for the ring gear 18. The axes of rotation are arranged parallel and spaced apart from one another. Pinion 16 and ring gear 18 are arranged in such a way that their external toothing 24 and internal toothing 26 mesh with each other in certain regions.

Both the external toothing 24 of the pinion 16 and the internal toothing 26 of the ring gear 18 are helically toothed.

A filler piece 30 is arranged within a crescent-shaped free space 28 formed between pinion 16 and ring gear 18. The filler piece 30 is supported on a stop pin 32 and consists of an inner sealing segment 34 and an outer sealing segment 36. The gap between the inner sealing segment 34 and the outer sealing segment 36 is sealed by a sealing roller 38.

In the housing 12, there also are pressure pockets 40 and 42, each of which is connected to a fluid connection 44 or 46 of the internal gear machine 10.

Figure 4:
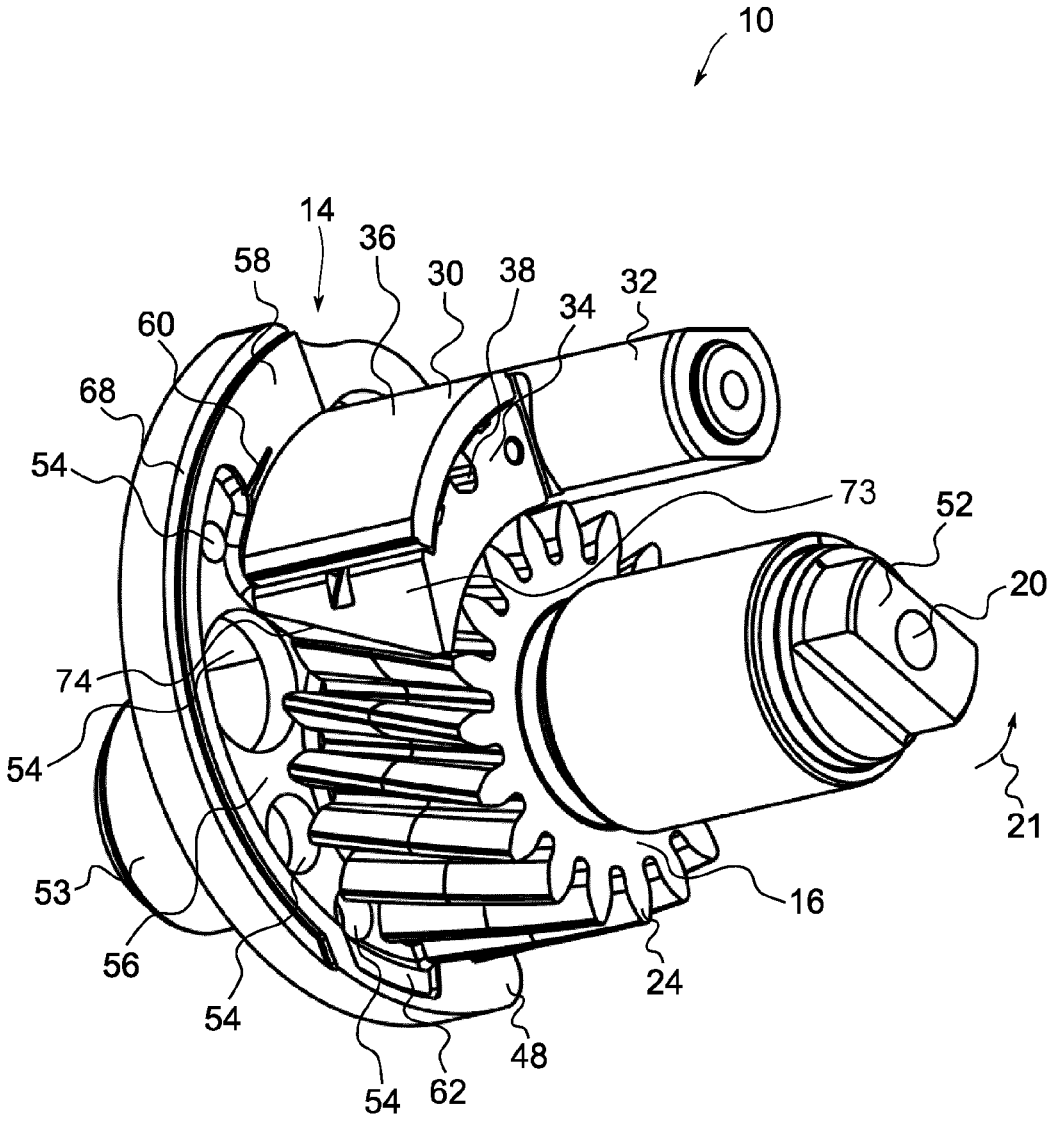
FIG. 4 a schematic perspective view of a part of an internal gear machine.

The design and mode of operation of such an internal gear machine 10 are known to the skilled person, so that a more detailed description is omitted here. During operation of the internal gear machine 10, the pinion 16 is driven by a drive shaft 52 (FIG. 4). This results in a clockwise direction of rotation around the longitudinal axis 20 as shown by the arrow 21, with the external toothing 24 of the pinion 16 driving the internal toothing 26 of the ring gear 18. This results-in a manner known per se-in enlarging and reducing pump chambers, into which the medium to be conveyed is first conveyed through the fluid connection 44 (which serves as a suction connection) and the pressure pocket 40 into the cavity 14 and is conveyed from there via the pressure pocket 42 to the fluid connection 46 (which serves as a pressure connection).

Fluid in the tooth gaps of the internal toothing 26 and the external toothing 24 then moves along the filler piece 30 with the tooth gaps and reaches the tooth engagement region of pinion 16 and ring gear 18. The fluid is displaced into the pressure pocket 42 and thus to the pressure connection 46 through the indicated radial bores 48 of the ring gear 18.

Figure 2:
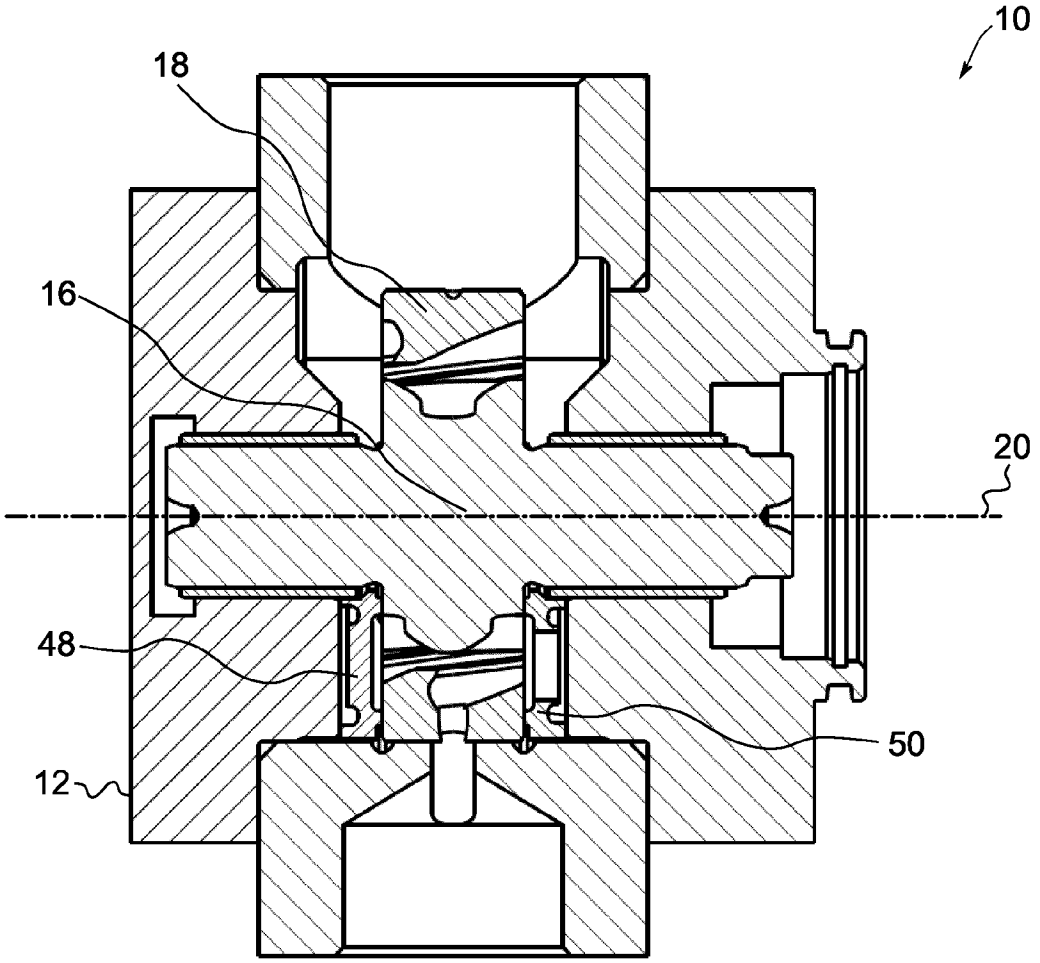
FIG. 2 a schematic plan view of a 2-quadrant internal gear machine.

FIG. 2 shows a sectional view of the internal gear machine 10 in plan view as shown in FIG. 1, perpendicular to the image plane of FIG. 1, at the height of the longitudinal axis 20.

FIG. 2 clearly shows that the gearbox consisting of pinion 16 and ring gear 18 is arranged within the cavity 14 of the housing 12. Axial discs 48 and 50 are arranged on both sides between the housing 12 and the gearbox consisting of pinion 16 and ring gear 18, which serve to seal the gap between the housing 12 and the gearbox consisting of pinion 16 and ring gear 18 both in the axial direction and in the radial direction. The design and mode of operation of the axial discs 48 and 50 are explained in more detail in the following figures.

Figure 3:
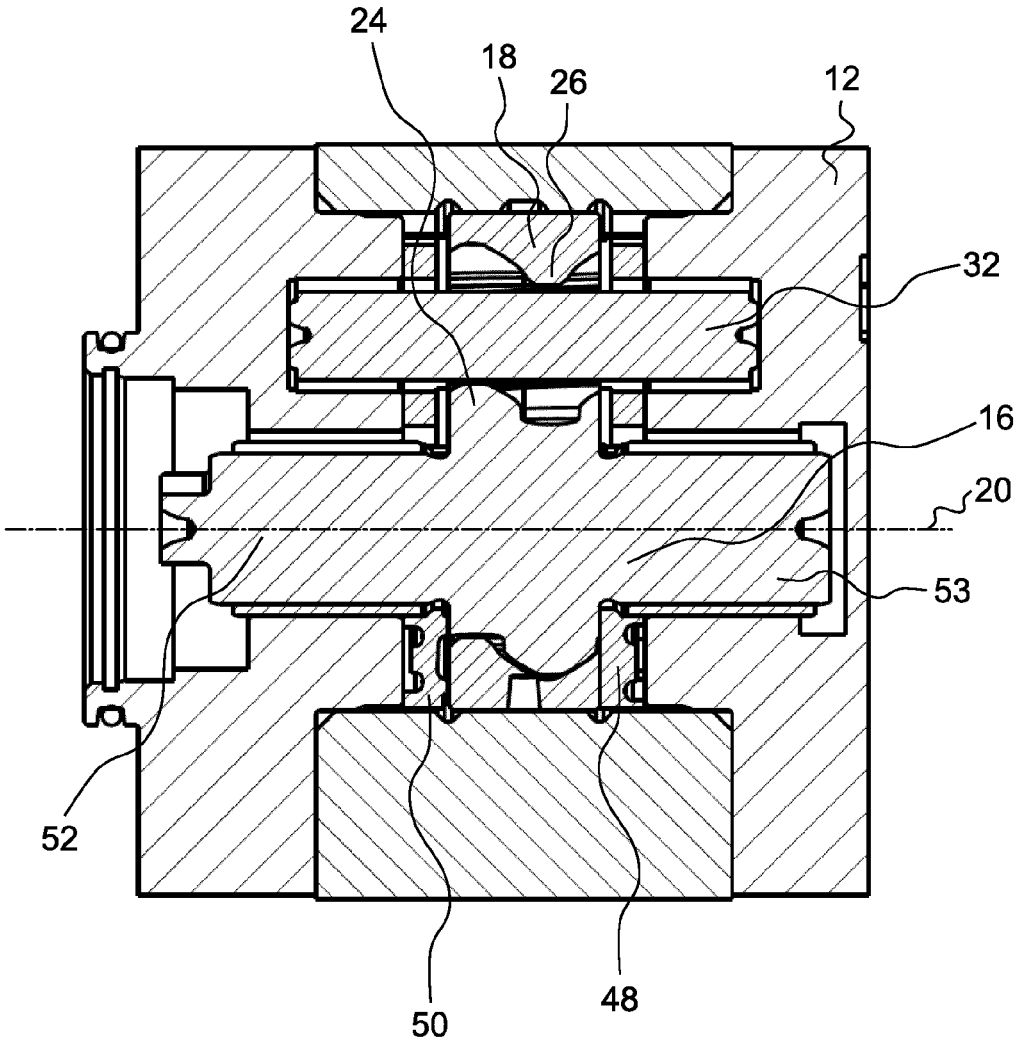
FIG. 3 a schematic side view of an internal gear machine.

FIG. 3 shows a further sectional view of the internal gear machine 10 along line A-A in FIG. 1. The same parts as in the previous figures are designated with the same reference numerals and are not explained again.

FIG. 4 shows a schematic perspective view of a part of the internal gear machine 10 shown in FIG. 1. Shown is the externally toothed pinion 16, which is arranged in a rotationally fixed manner on a drive shaft 52 and can be rotated about its longitudinal axis 20 (anti-clockwise—arrow 21—in relation to the illustration in FIG. 4) when coupled to a drive. The drive shaft 52 passes through the pinion 16 and has a bearing section 53, which is mounted in a corresponding bushing in the housing 12. For reasons of clarity, the ring gear 18 and the axial disc 50 are not shown in FIG. 4; in this respect, reference is made here to the illustration in the explanation of FIGS. 1, 2 and 3.

Also shown is the stop pin 32 against which the filler piece 30 rests with its inner sealing segment 34 and outer sealing segment 36. The sealing roller 38 is positioned between the sealing segments 34, 36.

The axial disc 48 delimiting the cavity 14 is also shown. The axial disc 48 has at least one fluid connection 54.

In the embodiment example shown, a total of 4 fluid connections 54 are provided, which are arranged spaced apart from one another in the circumferential direction of the axial disc 48 and have different diameters.

The fluid connections 54 are provided at the base of a pressure field 56 integrated into the axial disc 48. The pressure field 56 is formed by a kidney-shaped recess within the axial disc 48 on the side 58 of the axial disc 48 facing the cavity 14.

At least one relief groove 60 (also referred to as a control slot) extends from the pressure field 56 counterclockwise to the direction of rotation shown in FIG. 4.

The end of the pressure field 56 opposite the relief groove 60 has at least one pressure pocket 62, which extends radially outwards over the circumference of the external toothing 24 of the pinion 16.

Figure 5:
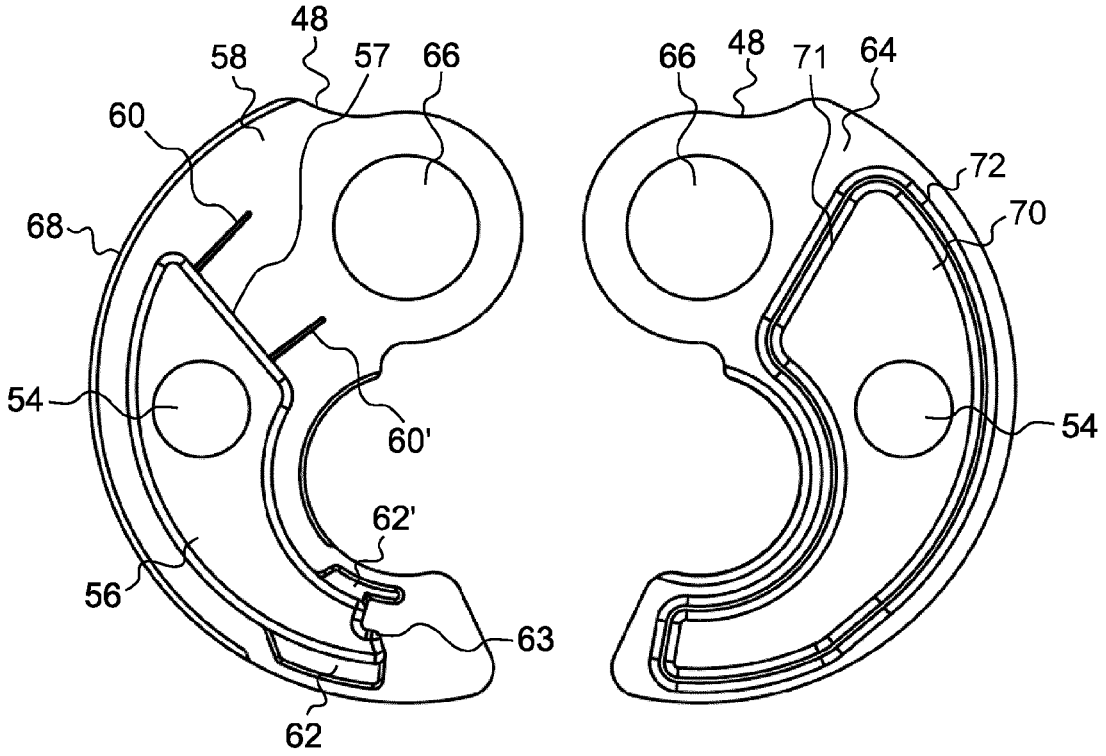
FIG. 5 views of a 2-quadrant axial disc.

FIG. 5 shows the axial disc 48 individually in a slightly modified version. The left-hand illustration shows the side 58 of the axial disc 48 facing the cavity 14. The right-hand side shows the axial disc 48 with its side 64 facing the housing 12.

The axial disc 48 has an opening 66 by means of which the axial disc 48 is fixed in the internal gear machine 10 via the stop pin 32, which engages through the opening 66.

In the example shown, the axial disc 48 has only one fluid connection 54. Two relief grooves 60 and 60' extend from the pressure field 56 on side 58. The pressure field 56 further comprises the radially outwardly directed pressure pocket 62 and an inwardly arranged pressure pocket 62' on the opposite side.

The axial disc 48 also has a radially outwardly directed end groove 68 on its side 58.

The right-hand illustration in FIG. 5 clearly shows that the axial disc 48 also has a pressure field 70 on its side 64 facing the housing 12, which is arranged opposite the pressure field 56, but is different in shape and size. The fluid connection 54 also opens into the pressure field 70, now from the other side of the axial disc 48. There is therefore a connection to the pressure field 70 via the fluid connection(s) 54 via the cavity 14, the pressure field 56.

The pressure field 70 is also formed by a trough-shaped recess in the axial disc 48. The pressure field 70 is surrounded by a sealing ring 72, via which the axial disc 48 rests against the housing 12.

Figure 6:
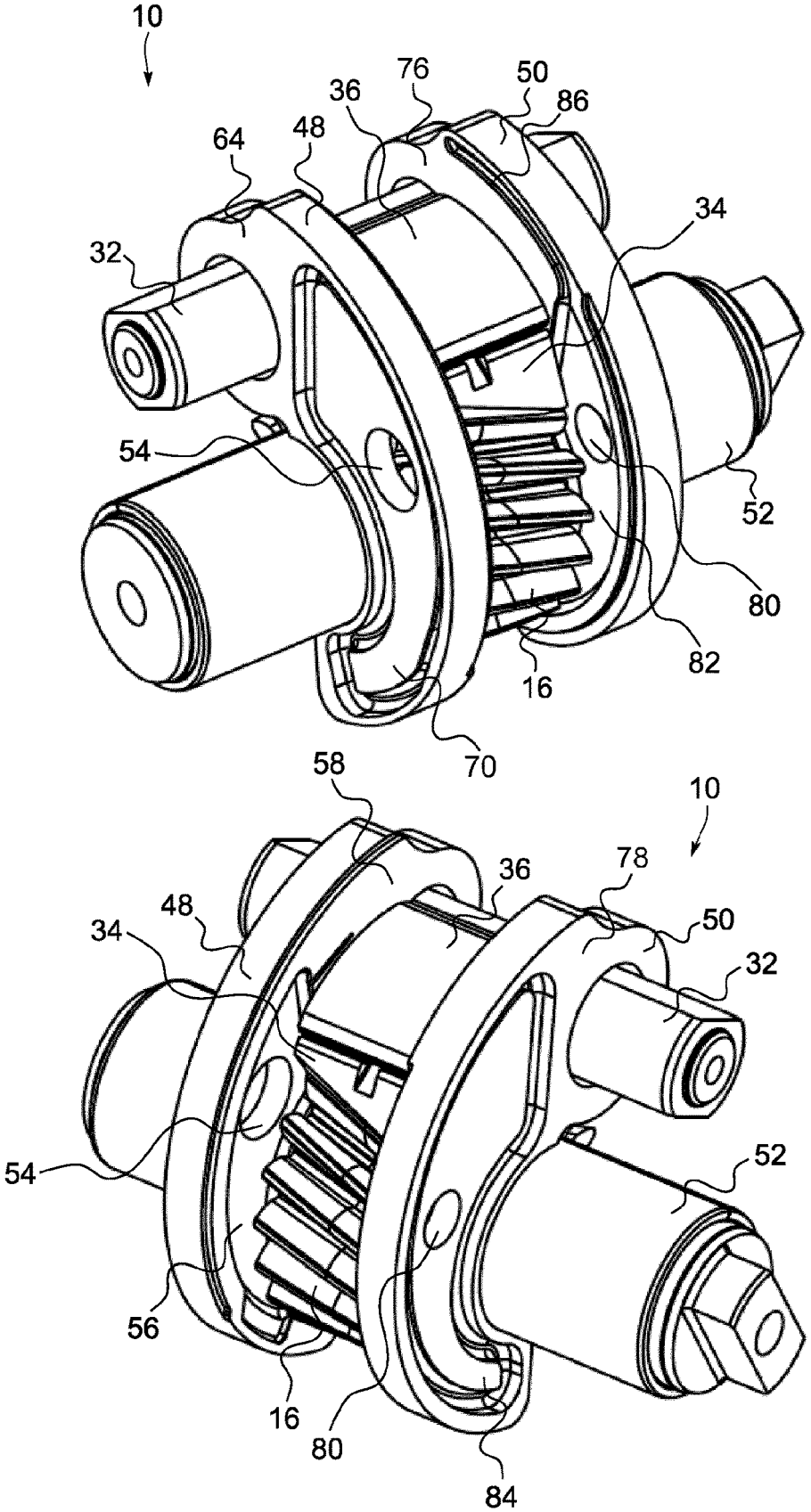
FIG. 6 schematic perspective views of the 2-quadrant internal gear machine.

FIG. 6 shows two schematic perspective views of the parts of the internal gear machine 10 already shown and explained in FIG. 4, supplemented by the axial disc 50.

FIG. 6 above shows the side 76 of the axial disc 50 that faces the pinion 16 and the ring gear 18. FIG. 6 below shows the side 78 of the axial disc 50 that faces the housing 12.

The same parts as in FIGS. 4 and 5 are designated with the same reference numerals and are not explained again.

The axial disc 50 also has a fluid connection 80, which extends from the base of a pressure field 82 towards a pressure field 84 on the side 78 of the axial disc 50. The pressure fields 82 and 84 are each formed by trough-shaped recesses on the sides 76 and 78 of the axial disc 50.

The pressure field 82 has at least one pressure pocket 86, which extends in the opposite direction to the direction of rotation of the pinion 16.

Figure 7:
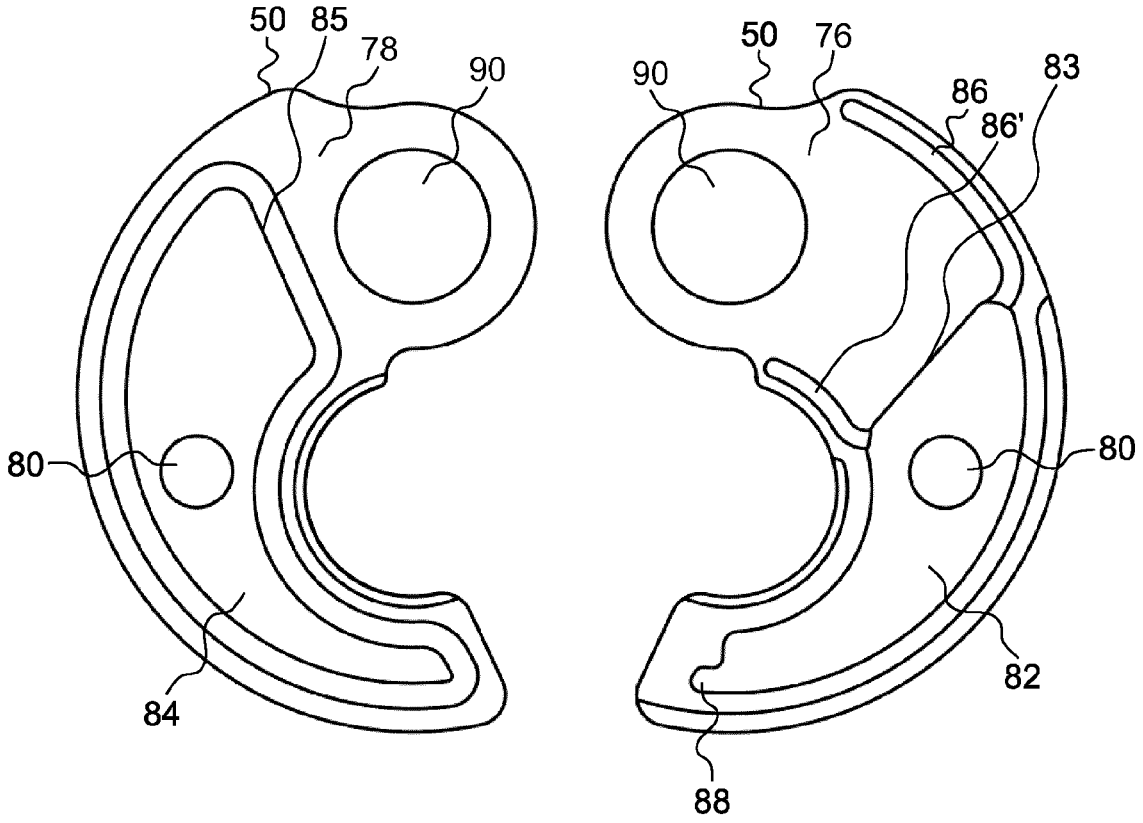
FIG. 7 views of another 2-quadrant axial disc.

FIG. 7 shows the axial disc 50 on the one hand from its side 78 (left-hand illustration) and on the other hand from its side 76 (right-hand illustration).

The pressure pockets 86 and 86' extend from the pressure field 82 on side 76. The pressure field 82 also has a pressure pocket 88 extending in the circumferential direction at the opposite end.

The axial disc 50 is also fixed to the stop pin 32 via the opening 90.

As FIG. 7 illustrates, the pressure field 82 is designed differently from the inner side 58 of the axial disc 48, which also faces the pinion 16 and ring gear 18. This different design takes account of the fact that different pressure conditions arise than on the axial disc 48. The different design ensures that the differently pressure-loaded running surfaces 58 and 76 of the axial discs 48, 50, which are geometrically caused by helical toothing, are each applied on both sides. In particular, this is achieved by the control edges 83 and 88 of the pressure field 82 being arranged in a twisted manner in the circumferential direction relative to the control edges 57 and 63 of the pressure field 56 of the axial disc 48.

The illustrations in FIG. 5 and FIG. 7 clearly show that that two control edges 57 and 63 of the pressure field 56 are each arranged in a twisted manner relative to the control edges 83 and 88 of the pressure field 82 in the circumferential direction of the axial discs 48 and 50 (i.e. have a different angular position in relation to the axis of rotation 20) The offset of the control edges 57 and 83 and of the control edges 63 and 88 preferably corresponds to the value resulting from the helix angle of the toothings 24 and 26 for the face section twist from the front side to the rear side of the toothings. This means that the control edges 57 and 63 run closer to the stop pin 32 than the control edges 83 and 88 when viewed in the circumferential direction.

The housing-side pressure fields 70 and 84 of both axial discs are preferably each designed with a surface centre of gravity congruent to the dynamically pressure-loaded surfaces defined by the pressure fields and the helical toothing in rotation on the respective end faces 58 and 76 of the axial disc in question, wherein preferably the overall pressure-loaded surfaces of pressure field 70 and 84 are each designed such that they exert a slightly increased pressure on both sides in the direction of the gearbox and thus the axial discs 48, 50 come to rest against the gearbox at every operating point. This effectively seals the end face of the gearbox.

The internal gear machine 10 shown in FIGS. 1 to 7 has the following functions:

By driving the drive shaft 52, a fluid, for example hydraulic oil, is drawn in via the fluid connection 44 and enters the cavity 14. The fluid is pumped past the filler piece 30 to the pressure connection 46 of the internal gear machine 10 via the meshing toothing of the pinion 16 and ring gear 18 in a manner known per se. The pressure fields 70 and 84 of both axial discs 48, 50 are supplied with pressure oil on the pressure side via the corresponding bores 54 and 80, so that both axial discs are brought to rest against the gearbox.

Due to the helical toothing of pinion 16 and ring gear 18, a tilting moment occurs transverse to the longitudinal axis 20 of pinion 16 and the longitudinal axis 22 of ring gear 18. This tilting moment is generated by the pressure oil present on the helical toothing in the region of the filler piece 30 and in the region of the tooth engagement by the drive torque of the pump and the pressure oil also present between the ring gear 18 and pinion 16. Both regions generate opposing radially offset axial thrusts, which cause the toothings to tilt This tilting moment is compensated for by the design of the axial discs 48 and 50. This compensation is achieved by the hydrostatic surfaces 62, 62' and 86, 86' arranged on the axial discs in a mutually non-congruent manner at the level of the respective line of action of the opposing axial thrusts in the region of the filler piece 30 and in the tooth engagement, which are each connected to the pressure fields 56 and 82. Particularly in the case of internal gear machines 10 that are operated at high pressures, for example 250 to 350 bar, this results in optimum compensation of the tilting moment while simultaneously maintaining axial and radial gap compensation. Radial and axial sealing can therefore be achieved with high efficiency.

The different, asymmetrical design of the pressure fields 56 and 70, in particular the relief grooves 60, 60' and the pressure pockets 62, 62' as well as the arrangement of the control edges 57 and 71, can counteract the tilting moment of pinion 16 and ring gear 18 and compensate for the tilting moment.

In further embodiments not shown, the pressure fields 70 and/or 84 can also be formed in the wall of the adjacent housing 12 instead of in the axial disc 48 or 50. Proportional formations of the pressure field 70 and/or 84 in the axial discs 48 and/or 50 and the housing 12 are also possible.

The compensation options described above, in particular of the tilting moment of pinion 16 and ring gear 18 transverse to their longitudinal axes 20 and 22, make it possible to realise high-performance helically toothed gear fluid machines in the high-pressure range.

The external toothing of the pinion 24 and the internal toothing of the ring gear 26 can be used with a high number of teeth, for example more than 15 teeth for the pinion 16 and more than 20 teeth for the ring gear 18. A degree of overlap of the tooth engagement of pinion 16 and ring gear 18 can be at least two, i.e. the region in which pinion 16 and ring gear 18 mesh completely with one another can be at least 2 teeth.

For example, a face section twist (helix angle) of the toothing can be 22.5 degrees with a number of teeth 19 on the pinion 16 and a gearbox width of 20 mm.

The helix angle depends on the number of teeth and the width of ring gear 18 or pinion 16 and can therefore vary.

It is possible to provide an internal gear machine with a large number of teeth on both the pinion 16 and the ring gear 18, which is helically toothed and therefore runs very smoothly and is also suitable for conveying a fluid in the high-pressure range. As a result, the overlapping region of pinion 16 and ring gear 18 between the pressure region and the suction region within the cavity 14 is well sealed, since a larger number of fully meshing teeth of the internal toothing 26 of the ring gear 18 or the external toothing 24 of the pinion 16 is possible along the engagement distance between pinion 16 and ring gear 18.

As can be seen further in FIG. 4, the inner sealing segment 34 has an incline 74 on its side 73 facing the pump chamber, the helix angle of which preferably corresponds approximately to the helix angle of the teeth of the external toothing 24 of the pinion 16 and the internal toothing 26 of the ring gear 18. These preferably corresponding helix angles of sealing segment 34 and teeth 24 and 26 lead to a particularly good reduction of pressure losses in internal gear machines with axial fluid connections 44 and 46.

The internal gear machine 10 described in the previous figures can be operated in reversing operation, i.e. both as a pump and as a motor. During pump operation, a fluid is sucked via the fluid connection 44 (suction side) and discharged under pressure at the fluid connection 46. For this purpose, the drive shaft 52 is driven in the manner described by an electric motor or in another suitable manner.

During motor operation, a pressurised fluid is fed into the fluid connection 46 so that the pinion 16 and ring gear 18 are set in rotation. The fluid is conveyed along the filler piece 30 to the fluid connection 44 via the pockets formed between the toothing. Due to the rotary movement of the pinion 16, an output torque can be tapped at its drive shaft 52 during motor operation.

Figure 8:
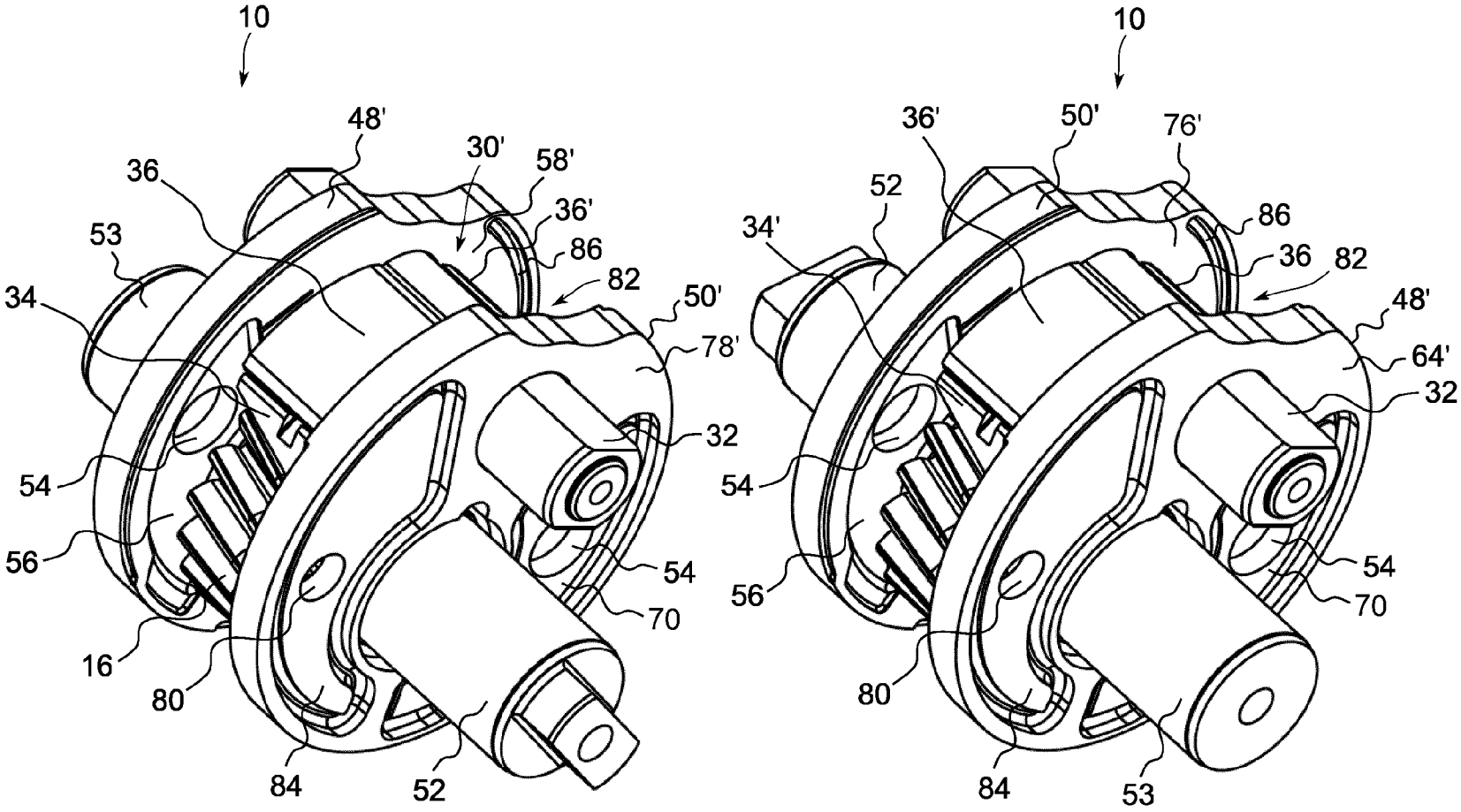
FIG. 8 schematic perspective views of a 4-quadrant internal gear machine and FIG. 9 views of a 4-quadrant axial disc.

FIG. 8 shows an assembly for an internal gear machine 10, by means of which the internal gear machine 10 can be operated in so-called four-quadrant mode. This means that the internal gear machine 10 can be operated as a pump in both directions and as a motor in both directions. Internal gear machines that can be operated in four-quadrant mode are generally known to those skilled in the art.

The same parts as in the previous figures are designated with the same reference numerals and are not explained again.

The difference to the previous figures lies in the design of the axial discs 48' and 50' and the filler piece 30'. In this respect, only the differences are discussed here and reference is made to the previous description with regard to the other parts and functions.

The axial discs 48' and 50' are designed here as fully circumferential discs. This means that the axial disc 48' has both a pressure field 56 on its side 58' and a pressure field 82 opposite the drive axis 52. Correspondingly, the outer side of the axial disc 50', which can be seen in the left-hand illustration in FIG. 8, has a pressure field 84 on its side 76' and a pressure field 70 opposite the drive axis 52.

In addition to the sealing segments 34 and 36, the filler piece 30' also has an inner sealing segment 34' and an outer sealing segment 36' on the side opposite the stop pin 32, which are constructed and arranged as a mirror image of the sealing segments 34 and 36.

This is clearly shown in the right-hand illustration of FIG. 8, in which the assembly shown in the left-hand illustration of FIG. 8 is shown in a schematic perspective view from the opposite side.

It can also be seen that the inner side 76' of the axial disc 50' has a pressure field 56 and a pressure field 82.

The outer side 64' of the axial disc 48' has a pressure field 84 and a pressure field 70.

The axial discs 48' and 50' are therefore inversely symmetrical to each other on their inner sides 58' and 76' and on their outer sides 78' and 64.

With regard to the design and function of the pressure fields provided in the axial discs 48' and 50' with their relief grooves and pressure pockets as well as control edges, reference is made to the explanation of the preceding figures.

Figure 9:
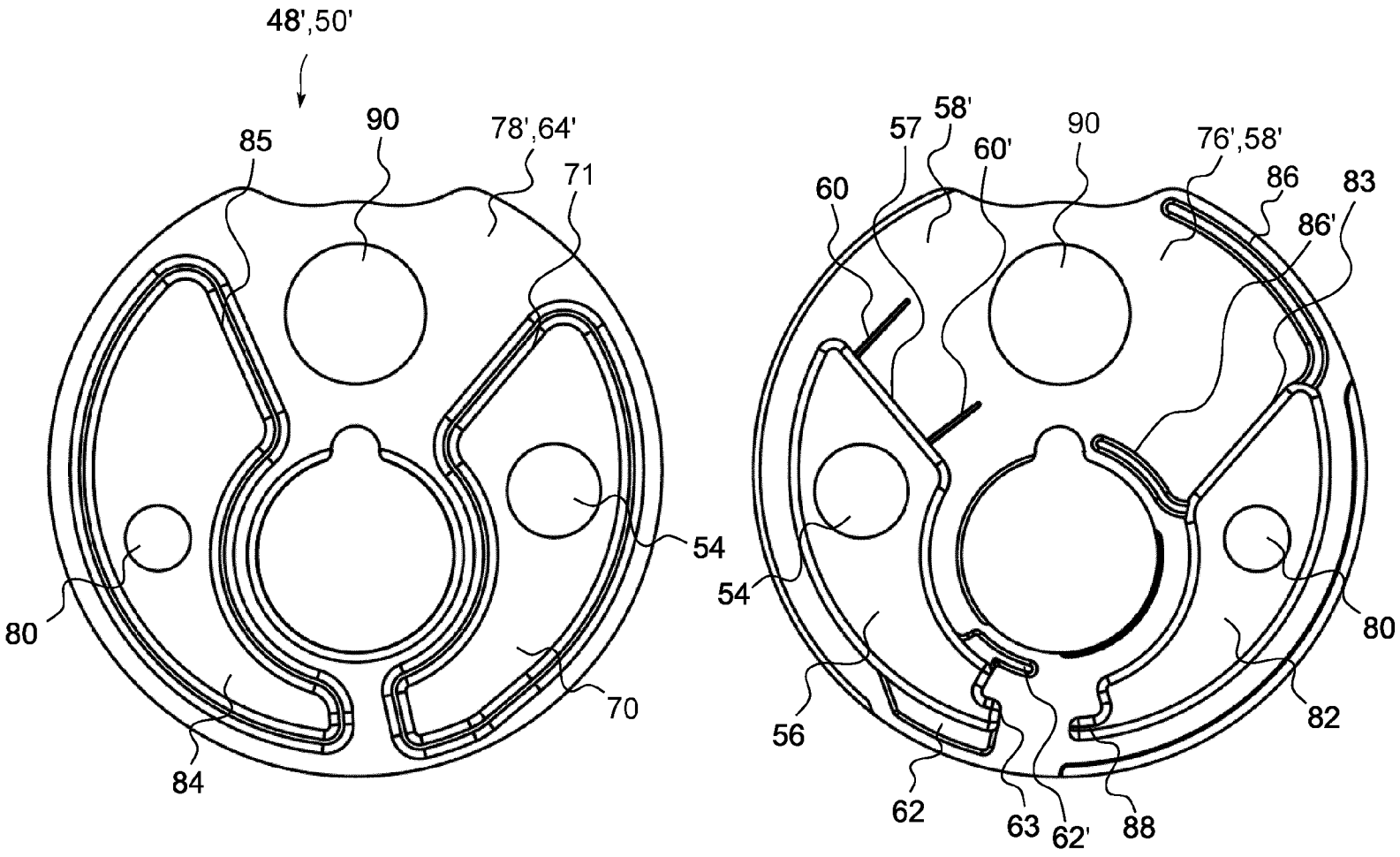

FIG. 9 once more shows a top view of the axial discs 48' and 50' again. The left-hand illustration in FIG. 9 shows the axial discs 48', 50' with their side 78' and 64' respectively. The right-hand illustration in FIG. 9 shows the axial discs 48', 50' with their inner side 76' and 58' respectively.

It is clear that the axial discs 48' and 50' have an identical design but are mounted upside down.

This design makes it possible to compensate for a tilting moment of pinion 16 and ring gear 18 at any time, even with an internal gear machine 10 that can be operated in so-called four-quadrant mode, regardless of its operating mode. At the same time, axial and radial gap sealing is guaranteed.

This means that such an internal gear machine 10 operating in four-quadrant mode can also be operated with high efficiency in the high-pressure range.

The internal gear machines 10 according to the invention can also be used according to the invention, for example, in the following ways: electrohydraulic/hydropneumatic chassis control systems, electrohydraulic steering systems, decentralised hydraulic applications in electrified vehicles.

REFERENCE NUMERALS

10 Internal gear machine
12 Housing
14 Cavity
16 Pinion
18 Ring gear
20 Longitudinal axis

21 Arrow
22 Longitudinal axis
24 External toothing pinion
26 Internal toothing ring gear
28 Free space
30,30' Filler piece
32 Stop pin
34.34' Sealing segment
36.36' Sealing segment
38 Sealing roll
40 Pressure pocket
42 Pressure pocket
44 Fluid connection
46 Fluid connection
48.48' Axial disc
50.50' Axial disc
52 Drive shaft
53 Bearing section
54 Fluid connection
56 Pressure field
57 Control edge
58 Side
60.60' Relief groove
62.62' Pressure pocket
63 Control edge
64 Side
66 Opening
68 End groove
70 Pressure field
71 Control edge
72 Sealing ring
73 Side
74 Incline
76.76' Side
78 Side
80 Fluid connection
82 Pressure field
83 Control edge
84 Pressure field
85 Control edge
86,86' Pressure pocket
88 Pressure pocket
90 Opening

The invention claimed is:

1. An internal gear machine comprising:

a housing that forms a cavity;

an internally toothed ring gear and an externally toothed pinion arranged in the cavity, wherein a plurality of toothings of the internally toothed ring gear and the externally toothed pinion are in meshing engagement with one another in one or more regions, axes of rotation of the internally toothed ring gear and the externally toothed pinion run parallel to one another and are spaced apart from one another, at least one filler piece rests against first and second toothings of the plurality of toothings and divides the cavity into two fluidically separate regions, the plurality of toothings is formed as helical toothing or arrow toothing, and surfaces axially closing off the cavity have mutually non-congruent pressure fields and control edges that are rotatable relative to one another in a circumferential direction.

2. The internal gear machine of claim 1, wherein a gearbox comprises the internally toothed ring gear and the externally toothed pinion and the control edges are twisted relative to one another in the direction of rotation by a face section twist between front and rear sides of the gearbox specified by the helical toothing.

3. The internal gear machine of claim 1, wherein the internally toothed ring gear is a helically toothed ring gear, the externally toothed pinion is a helically toothed pinion, and axial boundaries of the cavity on both sides each have at least one mutually non-congruent hydrostatic pressure field configured such that a thrust exerted by the helically toothed pinion and the helically toothed ring gear in a region of the at least one filler piece, acting axially on one side, and an axial thrust acting in a region of a tooth engagement, acting axially in the opposite direction to the first, are at least partially hydrostatically compensated in terms of area.

4. The internal gear machine of claim 1, wherein the cavity is axially bounded by at least one first axial disc, the at least one first axial disc has at least one fluid connection between the cavity and a pressure field provided on a side of the at least one first axial disc facing away from the cavity and/or at least one pressure field is provided on the housing on a side facing the at least one first axial disc, which is connected to the at least one fluid connection, and at least one pressure field is provided on a side of the at least one first axial disc facing the cavity which is connected to the at least one fluid connection.

5. The internal gear machine of claim 4, further comprising:

at least one second axial disc in addition to the at least one first axial disc on an opposite axial boundary of the cavity of the internal gear machine, which has a fluid connection between the cavity and a pressure field provided on the side of the at least one first axial disc facing away from the cavity and/or at least one pressure field is provided on the side of the housing facing the at least one second axial disc, which is connected to the fluid connection, and at least one pressure field is provided on a side of the at least one second axial disc facing the cavity which is connected to the fluid connection.

6. The internal gear machine of claim 5, wherein the sided of the at least one first axial disc facing the cavity and/or the side of the at least one second axial disc facing the cavity comprises one or more relief grooves and/or one or more pressure pockets.

7. The internal gear machine of claim 5, wherein at least one of the at least one first axial disc, the at least one second axial disc, and the housing comprises, in a region of the at least one first axial disc and the at least one second axial disc, an axial recess resulting in a first pressure field and a second pressure field.

8. The internal gear machine of claim 7, wherein the axial recess is surrounded by a sealing system.

9. The internal gear machine of claim 8, wherein the sealing system is a sealing ring.

10. The internal gear machine of claim 1, wherein that at least one filler pieces are designed with an incline towards the outlet following an incline of the plurality of toothing.

11. The internal gear machine of claim 1, wherein a gearbox comprises the internally toothed ring gear and the externally toothed pinion and the plurality of toothings has a helix angle with a relative rotation of a face section tooth contour from a front side of the gearbox to a rear side of the gearbox which corresponds to at least half a tooth pitch.

12. The internal gear machine of claim 11, wherein the plurality of toothings has a helix angle with a relative rotation of a face section tooth contour from the front side of the gearbox to the rear side of the gearbox corresponding to a full tooth pitch.

13. The internal gear machine of claim 1, wherein a gearbox comprises the internally toothed ring gear and the externally toothed pinion, a first surface axially closing off the cavity has first non-congruent pressure fields when viewed axially, and in that a second surface closing off the cavity has second non-congruent pressure fields opposite the first surface, wherein the first and second non-congruent pressure fields of the first and second surfaces are configured to be inversely symmetrical to a center plane of the gearbox.

14. The internal gear machine of claim 13, wherein the first surface axially closing off the cavity is formed by at least one first axial disc axially enclosing the internally toothed ring gear and the second surface axially closing off the cavity oppositely is formed by at least one second axial disc axially enclosing the internally toothed ring gear.

15. The internal gear machine of claim 1, wherein the internal gear machine is a pump having the at least one filler piece comprising a plurality of filler pieces, wherein the plurality of filler pieces are arranged symmetrically when viewed axially and configured to implement a reversing operation or a four-quadrant operation, wherein the plurality of filler pieces rest against at least one retaining pin on the left and right sides when viewed axially.

16. A device selected from the group consisting of electrohydraulic/hydropneumatic chassis control systems, electrohydraulic steering systems, and decentralised hydraulic applications in electrified vehicles, wherein the device comprises the internal gear machine of claim 1.

* * * * *